US006794099B1

(12) United States Patent
Chen et al.

(10) Patent No.: US 6,794,099 B1
(45) Date of Patent: Sep. 21, 2004

(54) HIGH CONTRAST INDICATOR ELEMENT

(75) Inventors: Wen-Li A. Chen, Rochester, NY (US); Robert P. Bourdelais, Pittsford, NY (US); Cheryl J. Kaminsky, Webster, NY (US); Richard A. Castle, Webster, NY (US); Thomas M. Smith, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/409,500

(22) Filed: Apr. 8, 2003

(51) Int. Cl.[7] ..... G03C 1/765; G03C 1/77; G03C 1/795

(52) U.S. Cl. ..... 430/15; 430/14; 430/502; 430/523; 430/524; 430/525; 430/531; 430/635; 430/950

(58) Field of Search ..... 430/525, 524, 430/950, 523, 533, 531, 502, 14, 15

(56) References Cited

U.S. PATENT DOCUMENTS

| | | | | |
|---|---|---|---|---|
| 4,695,532 A | | 9/1987 | Ponticello et al. | |
| 4,948,719 A | * | 8/1990 | Koike et al. | 430/525 |
| 5,139,870 A | * | 8/1992 | Koike et al. | 430/525 |
| 5,508,088 A | | 4/1996 | Braun | |
| 5,639,589 A | | 6/1997 | Bauer et al. | |
| 5,672,865 A | | 9/1997 | Braun | |
| 5,828,047 A | | 10/1998 | Ruckert | |
| 5,866,282 A | | 2/1999 | Bourdelais et al. | |
| 5,945,266 A | * | 8/1999 | Maskasky et al. | 430/524 |
| 6,063,552 A | | 5/2000 | Bourdelais et al. | |
| 6,291,150 B1 | | 9/2001 | Camp et al. | |
| 6,437,324 B1 | | 8/2002 | Braun et al. | |

* cited by examiner

*Primary Examiner*—Richard L. Schilling
(74) *Attorney, Agent, or Firm*—Paul A. Leipold

(57) ABSTRACT

The invention relates to a material to form an indicator element comprising a base material and at least one photosensitive silver halide layer, wherein the base material comprises at least one specular reflective layer between two polymer layers wherein the polymer layer between the at least one specular reflective layer and the silver halide layer is substantially transparent.

47 Claims, No Drawings

HIGH CONTRAST INDICATOR ELEMENT

FIELD OF THE INVENTION

This invention relates to the formation of an indicator element containing a high contrast silver halide imaging layers and metallic reflective layers for a timing device.

BACKGROUND OF THE INVENTION

Indicator elements or timing elements allow devices such as ink jet print heads to be accurately positioned in space. In general, timing control elements are either rotatable about a central axis, i.e., timing disk, or are movable in a linear direction, i.e., timing rule. Light, projected by a transmitter, passes through the control element, and is intercepted by the receiver. The receiver, responsive to the light, converts the light into an electrical signal capable of controlling machinery and other servo-mechanical devices.

Timing control elements typically are encoded with a selected window pattern, i.e., they have an annular or linear array of windows which alternate in a transparent window, opaque window, transparent window, opaque window pattern. While the transparent window openings allow the transmitted light to pass through the timing disk or rule, the opaque windows prevent the light from passing through the timing disk or rule.

Timing disks as a rule are fixed to a rotating shaft by means of a hub. For linear systems, timing rules are arranged at right angles to a source of light and the associated receiver generates an electrical signal in response to the incoming light. This particular application is used, for example, to control the feeding action of machine tools.

As the timing disk rotates or the timing rule moves in a linear direction, light is directed at the selected window pattern. Because of the window pattern, the transmitted light can only pass through a transparent window. In response to the light, the receiver generates an electrical signal.

The electrical signals serve to establish a control surface for the measurement of rotational speed, acceleration and more accurate positioning of servomechanical elements, as for example a printing head, a robot arm or a tool carrier.

Timing control elements can be made of glass, metal or plastic, however, plastic and metal are typically used in mass production applications. They are produced, for example, in the case of angle indicators or encoding units, e.g. ink jet printers, out of transparent films.

Timing control elements are generally constructed of light-sensitive film. Coding of the film occurs when the film is exposed to light passed through a template means. The coding results in the production of an alternating pattern of transparent and opaque windows. Individual disks or rules are then cut out of the film material to generate timing disks or timing rules, respectively.

Known timing devices utilize an arrangement whereby the transmitter is placed on one side of the timing structure and the receiver is placed on the other side of the timing structure to capture the light as it passes through the disk. This arrangement has been known to cause a number of problems, including: a requirement for a complex electro-mechanical apparatus, increased mechanical stress caused by oscillating loads, a larger footprint size for the timing device, and dirt forming on the timing structure, thereby preventing light from passing efficiently through the structure.

U.S Pat. Nos. 5,508,088 and 5,672,865 describe a timing device that comprises a metallic layer and a silver halide layer. While the invention does provide a timing device of good quality, it none the less suffers from poor adhesion of the light sensitive silver halide layers to the metallic layer. Poor adhesion results in the light sensitive layers delaminating from the metallic layers during wet processing and during final use as a timing device. Further, it is well known that most metals negatively impact the quality and density uniformity of the disclosed light sensitive silver halide layers. Finally, direct application of silver halide imaging layers to a metal layer may result in a significant reduction in the reflective properties of the metal layer as the metal layer can undergo oxidation at the moisture bearing silver halide gelatin binder interface reducing the quality of the timing device.

It has been shown that application of primer materials to the surface of the metallic layers does not achieve sufficient adhesion between the light sensitive silver halide layers and the metal layers. Further, the application of primer materials tends to reduce the reflectivity of the metal reflective layer requiring higher power sources for timing devices.

U.S. Pat. No. 6,291,150 describes a photographic print materials that contains a foil layer to provide an opaque layer to prevent high density backside ink printed graphics from interfering with the front side image. Further, the foil layer provides an oxygen and moisture barrier for the light sensitive imaging layers which improves the speed performance of unexposed light sensitive layers and improved fade resistance of printed and processed images.

U.S. Pat. Nos. 4,695,532 and 4,689,359 describe a discharge treated polyester film support having coated directly thereon a subbing layer comprising a mixture of gelatin and an aqueous vinyl acrylate copolymer having a ratio of gelatin to polymer of between 5:95 to 40:60 and a dry coverage of between 0.11 and 0.55 g/m.sup.2. Although this subbing system has good adhesion before processing, it has been found that adhesion after contact with photographic developing solutions is severely degraded. U.S. Pat. No. 5,639,589 (Bauer et al) describes a coating to improve adhesion of light sensitive silver halide imaging layers to polyester film.

PROBLEM TO BE SOLVED BY THE INVENTION

There remains a need for a highly reflective timing element that has improved adhesion between the imaging layers and the reflective substrate. Further, there is also a need to protect the metal layer from scratching and abrasion.

SUMMARY OF THE INVENTION

It is an object of the invention to prove a highly reflective timing element

It is another object to provide a high contrast between the transmissive areas and opaque areas of the timing device It is a further object to provide improved adhesion between the imaging layers and the reflective base.

These and other objects of the invention are accomplished by a material to form an indicator element comprising a base material and at least one photosensitive silver halide layer, wherein said base material comprises at least one specular reflective layer between two polymer layers wherein said polymer layer between said at least one specular reflective layer and said silver halide layer is substantially transparent.

ADVANTAGEOUS EFFECT OF THE INVENTION

The invention provides improved adhesion between the imaging layers and the highly reflective substrate. Further the invention provides a protective surface for the delicate metal layer and provides a double sided timing device.

DETAILED DESCRIPTION OF THE INVENTION

The invention has numerous advantages compared to prior art timing devices. The invention provides excellent adhesion between the imaging layers and the base material of the invention compared to prior art silver halide timing devices in which the light sensitive layers are directly applied to the surface of the metal. It has been shown that direct application of the silver halide imaging layers to the surface of the metal results in poor imaging layer adhesion which significantly reduces the quality of the timing device. Improved adhesion also enables the timing device to withstand the rigors of extreme temperature changes such as those found in military aircraft. Extreme temperature changes in the different material layers results in different thermal expansion rates causing fracture sites at the imaging layer/reflective support interface.

The invention provides a protective surface to the delicate metal surface that is resistive to scratching and abrasion, which significantly reduces the quality of the timing device. Further, the transparent polymer sheet located between the metallic layer and the light sensitive silver halide layer provides a smooth layer on which the light sensitive layers are applied. Smooth coating surfaces to which the imaging layers are applied, increases the contrast ratio between the exposed and unexposed areas of the timing device improving the single to noise ratio compared to rough imaging layers. Since the light sensitive silver halide imaging layers are subject to curling forces at relative humidity less than 40%, the invention provides resistance to curl by application of an anti-curl layer opposite the imaging layers.

The invention also provides a timing device which contains positioning information on both the front and back side of the timing device. Timing information on both the front and back sides provides a significant increase in the amount of positioning information compared to single sided timing devices. Two sides timing devices save space, allowing the same device to have more information and can provide timing redundancy for critical applications such as military aircraft or elevators, were the failure of a timing device could result in the loss of equipment or human life. The amount of information containing in the timing device is also improved by utilizing a patterned metallic reflective layer. By utilizing a patterned metallic layer, two information modalities can exist in the same timing device. Further, by combining patterned metallic reflective layers and two sided imaging layers, the exposing light energy can expose both sides simultaneously with excellent registration. These and other advantages will be apparent from the detailed description below.

The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{-D}*100$ where D is the average of the red, green and blue Status A transmission density response of the processed minimum density of the photographic element as measured by an X-Rite model 310 (or comparable) photographic transmission densitometer. The term as used herein, "duplitized" means light sensitive silver halide coating on the topside and the bottom side of the base.

The term "light" means visible light. The term "diffuse light transmission" means the percent diffusely transmitted light at 500 nm as compared to the total amount of light at 500 nm of the light source. The term "total light transmission" means percentage light transmitted through the sample at 500 nm as compared to the total amount of light at 500 nm of the light source. This includes both spectral and diffuse transmission of light. The term "diffuse light transmission efficiency" means the ratio of % diffuse transmitted light at 500 nm to % total transmitted light at 500 nm multiplied by a factor of 100. The term "polymeric film" means a film comprising polymers. The term "polymer" means homo- and co-polymers.

In order to provide a high quality, high precision timing device a material to form an indicator element comprising a base material and at least one photosensitive silver halide layer, wherein said base material comprises at least one specular reflective layer between two polymer layers wherein said polymer layer between said at least one specular reflective layer and said silver halide layers are substantially transparent is preferred. The silver halide imaging layer(s) of the invention provides high contrast between the exposed areas and unexposed areas increasing the signal to noise ratio compared to ink printed indicator lines. Further, the high contrast silver halide imaging layers can be digitally written with a laser exposing device allowing for sharp indicator lines and customization of the timing devices. The highly reflective layer is protected with a polymer layer and the polymer layer provides an excellent coating surface and allows for excellent adhesion for the light sensitive silver halide imaging layers.

In a preferred embodiment the material of the invention comprises an encoder. The highly specular reflecting layers and the high contrast silver halide imaging layers provide high signal to noise ratio. Further, because the specular reflecting layers are protected from scratching and ambient moisture, the encoder of the invention is durable and long lasting. A preferred encoder comprises a disk encoder. A disk encoder is radial and thus uses space very efficiently. To produce a disk encoder, the printed and processed material of the invention may be die cut to the desired shape. The die cut disk may also be laminated to a stiffening member to further improve the flatness of the material of the invention.

In a preferred embodiment, the specular reflecting layer comprises a metal. Metal layers thin, have high reflectivity and can be patterned by such methods as laser ablation. The adhesion of a metallic layer to paper or polymer is difficult and therefore the choice of material for adhesion is important to assure proper functionality of the final photographic element. The metallic layer may either be chemically primed to promote adhesion or coated with a heat or pressure sensitive adhesive. The metal or metallized layer can comprise at least one material from the following list of aluminum, nickel, steel, gold, zinc, copper, titanium, metallic alloys as well as inorganic compounds such as silicon oxides, silicon nitrides, aluminum oxides or titanium oxides. The most preferred metal layer comprises silver. Metallic silver has been shown to have over 95% reflectivity between 350and 750 nm. Further, metallic silver has a low level of interaction with the silver halide imaging layers compared to metals that contain high amounts or iron. Finally, silver has a low oxidation rate and thus remains highly reflective over the lifetime of a typical timing.

In another preferred embodiment of the invention, the specular reflecting layer comprises alternating layers of polymer with a difference in index of refraction greater than 0.05. The alternating layers of polymer arc preferred because they do not contain metal that could interfere with radio frequency communications. An example of a preferred polymeric multi-layer reflector comprising alternating poly (ethylene naphthalate) (PEN) optical layers composed of a high refractive index polymer and poly(methyl methacrylate) (PMMA) optical layers that is composed of a low refractive index polymer. Such a polymeric multi-layer reflector has at least a number (preferably at least 30 and more preferably from 300 to 1000) of repeating optical layers of alternating high and low refractive index. Such reflectors are often referred to as "dielectric mirrors" or "dielectric stacks." Visible radiation is reflected at each interface with a change in refractive index.

In order to protect the delicate, highly reflective metal, the substantially clear polymer comprises polyester. Polyester is preferred because it is low in cost, has excellent smoothness and is tough compared to polymers such as polyolefin. Preferred polyesters for the transparent polymeric film useful in the invention include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. No. 2,465,319 and U.S. Pat. No. 2,901,466. Preferred polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

In another preferred embodiment, the polymer layers of the invention are selected from a group consisting of cellulose triacetate, polyethylenenapthalate, and polycarbonate. Cellulose triacetate is preferred because of the low birefringence and excellent imaging layer adhesion. birefringence is preferred because it reduces noise in the source/receiver system used for reflective timing devices. The optical anisotropy or birefringence is expressed by the product of the film thickness d and the birefringence $\Delta n$ which is a difference between the refractive index in the slow optic axis direction and the refractive index in the fast optic axis direction in the plane of the film, i.e. $\Delta n*d$ (retardation). The orientation direction coincides with the drawing axis in the film of the present invention. The drawing axis is the direction of the slow optic axis in the case of a thermoplastic polymer having a positive intrinsic birefringence and is the direction of the fast optic axis for a thermoplastic polymer having a negative intrinsic birefringence. There is no definite requirement for the necessary level of the value of $\Delta n.*$ d since the level depends upon the application of the polymer layer and the desired signal to noise ratio.

Polycarbonate is preferred because of the high light transmission and excellent mechanical properties. Polycarbonate, while having a birefringence higher than cellulose triacetate, is relative low compared to other crystalline polymers. Polyethylenenapthalate is preferred because of the high index of refraction, which is typically in the range of 1.75 to 1.85 (depending on the extent of orientation). High index of refraction improves the light directing efficiency of the invention allowing more reflected light to be focused toward a detector.

In a preferred embodiment of the invention, the base comprises multiple layers of specular reflecting layers. It has been found that one layer of specular reflecting layer occasionally suffers from unwanted pinholes. Pinholes are the result of incomplete metallization of one of the polymer layers and can allow incident light energy to be transmitted thru the material of the invention causing a false timing signal. By utilizing two or more layers of specular reflecting material, pinholes are substantially reduced yielding a higher quality timing device. Two layers of metal, each applied to one surface of the polymer layers and subsequently laminated together with a pressure sensitive adhesive has been found to provide a significant reduction in pinholes.

The base of the invention preferably has a specular reflectivity of between 65 and 99.5%, more preferably between 95 and 99.2%. High specular reflectivity improves the signal to noise ratio and also allows lower power emitters to be utilized saving energy and lowering cost. Metallic silver has been found to provide specular reflectivity between 95 and 99.2%.

The base of the invention has a metal thickness between 500 and angstroms, more preferably between 800 and 1500 angstroms. Metal layers with a thickness less than 400 angstroms do not provide the desired reflectivity since greater than 20% of the source light is transmitted through the base. Above angstroms, little improvement in reflectivity is observed and therefore not cost justified. Metallic specular reflecting layers between 800 and 1500 angstroms have been found to provide excellent specular reflection and low pinhole counts.

For the base of the invention, subbing layers are preferred to improve adhesion between the transparent polymer layer and the light sensitive silver halide imaging layers of the invention. For cellulose triacetate gelatin nitrate is preferred as a subbing layer to promote adhesion between the imaging layers and the transparent polymer. For poly(ethylene naphthalate) (PEN) and Poly(ethylene terephthalate) (PET), subbing materials disclosed in U.S. Pat. No. 5,639,589 have been shown to provide excellent adhesion. A preferred subbing layer comprises a mixture of gelatin and vinyl monomer because it provides excellent adhesion and is substantially transparent. For PET, subbing materials disclosed in U.S. Pat. No. 3,501,301 has been shown to provide excellent adhesion and generally are substantially transparent.

In a preferred embodiment of the invention, the subbing layer has substantially the same index of refraction as the transparent polymer layer. By index of refraction matching the subbing layer to the transparent polymer layer, unwanted reflection from the subbing layer is substantially reduced thereby increasing the signal to noise ratio of the emitted/detector utilizing for reflective encoders. An index of refraction difference between the transparent polymer sheet and the subbing layer within 0.05 is preferred. A difference less than 0.05 has been shown to improve the signal to noise ratio by 2% compared to an index of refraction difference of 0.12.

In another preferred embodiment if the invention, the specular reflecting layer comprises a pattern of specular reflecting areas and highly transmissive areas. Patterning of the specular reflecting layer can be accomplished by methods known in the art such as laser ablation of metal, photolithography, and masking desired areas with release chemistry. Patterning of the specular reflecting layer provides a timing device that can be both reflective and transmissive. Further, two indicator patterns can be used on the timing device, one that is resident in the patterned specular reflecting layer and the second in the light sensitive silver halide layer.

In a preferred embodiment of the invention, the material of the invention further comprises an adhesive layer between the specular reflecting layer and the polymer layer opposite the silver halide layer. An adhesive allows the metallic layer to be adhered on the polymer layer opposite the silver halide layer. Preferred adhesives are substantially transparent pressure sensitive adhesives. Organic pressure sensitive adhesives may be natural or synthetic. Examples of preferred natural organic pressure sensitive adhesives include bone glue, soybean starch cellulosics, rubber latex, gums, terpene, mucilages and hydrocarbon resins. Examples of synthetic organic pressure sensitive adhesives include elastomer solvents, polysulfide sealants, theromplastic resins such as isobutylene and polyvinyl acetate, theromsetting resins such as epoxy, phenoformaldehyde, polyvinyl butyral and cyanoacrylates and silicone polymers.

For single or multiple layer pressure sensitive adhesive systems, the preferred pressure sensitive adhesive composition is selected from the group consisting of natural rubber, syntheic rubber, acrylics, acrylic copolymers, vinyl polymers, vinyl acetate-, urethane, acrylate- type materials, copolymer mixtures of vinyl chloride-vinyl acetate, polyvinylidene, vinyl acetate-acrylic acid copolymers, styrene butadiene, carboxylated stryrene butadiene copolymers, ethylene copolymers, polyvinyl alcohol, polyesters and copolymers, cellulosic and modified cellulosic, starch and modified starch compounds, epoxies, polyisocyanate, polyimides.

In a preferred embodiment of the invention, the material of the invention further comprises a substantially transparent dye located between the silver halide layer and the specular reflective layer or in the specular reflective layer. Transparent dyes allow the emission light energy to be color shifted to a different wave length. For example, a dye between the silver halide layer and specular reflective layer, allows highly efficient red light emitters and blue detectors to be utilized.

The absorption characteristics of a given colorant will vary to some extent with a change in colorant amount (transferred and blue density). This is due to factors such as a measurement flare, colorant-colorant interactions, colorant-receiver interactions, colorant concentration effects, and the presence of color impurities in the media. However, by using characteristic vector analysis (sometimes refereed to as principal component analysis or eigen-vector analysis), one can determine a characteristic absorption curve that is representative of the absorption characteristics of the colorant over the complete wavelength and density ranges of interest. The characteristic vector for each colorant is, thus, a two-dimensional array of optical transmission density and wavelength. This technique is described by Albert J. Sant in Photographic Science and Engineering, 5(3), May–June 1961 and by J. L. Simonds in the Journal of the Optical Society of America, 53(8), 968–974 (1963). Examples of 'red' dyes (IR-1 and IR-2) useful in the invention are:

IR-1

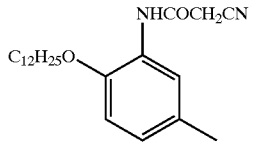

IR-2

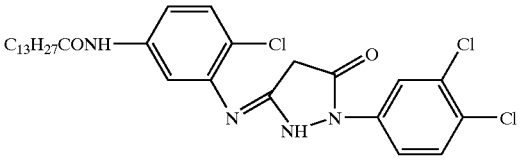

In order to provide a timing device the light sensitive silver halide imaging layers applied to the base of the invention must be printed with an indicator pattern and processed to develop the latent image of the indicator pattern. Typical indicator patterns comprise evenly spaced lines, gradients, concentric geometric patterns, line patterns containing a frequency of repeats and transparent holes. The indicator lines are formed by metallic silver.

To further protect the imaged indicator pattern application of an environmental protection layer or overcoat layer is preferred. The environmental protection layer protects the delicate indicator pattern and reduces the rate of moisture flow in and out of the gelatin binder utilized as a binder for the silver halide imaging layer. The protective overcoat layer may consist of suitable material that protects the image from environmental solvents, resists scratching, and does not interfere with the light transmission quality. The protective overcoat layer is preferably applied to the conductive material in either a uniform coating or a pattern wise coating. In a preferred embodiment of the invention the protective overcoat is applied in the presence of an electric field and fused to the topmost layer causing the transparent polymer particles to form a continuous polymeric layer. An electrophotographic toner applied polymer is preferred, as it is an effective way to provide a thin layer.

In another embodiment, the protective overcoat layer is coatable from aqueous solution and forms a continuous, water-impermeable protective layer in a post-process fusing step. The protective overcoat layer is preferably formed by coating polymer beads or particles of 0.1 to 50 $\mu$m in average size together with a polymer latex binder on the emulsion side of a sensitized photographic product. Optionally, a small amount of water-soluble coating aids (viscosifiers, surfactants) can be included in the layer, as long as they leach out of the coating during processing. After coating the sheet is treated in such a way as to cause fusing and coalescence of the coated polymer beads, by heat and/or pressure (fusing), solvent treatment, or other means so as to form the desired continuous, water impermeable protective layer.

Examples of suitable polymers from which the polymer particles used in protective overcoat layer can be selected include poly(vinyl chloride), poly(vinylidene chloride), poly (vinyl chloride-co-vinylidene chloride), chlorinated polypropylene, poly(vinyl chloride-co-vinyl acetate), poly (vinyl chloride-co-vinyl acetate-co-maleic anhydride), ethyl cellulose, nitrocellulose, poly(acrylic acid) esters, linseed oil-modified alkyd resins, rosin-modified alkyd resins, phenol-modified alkyd resins, phenolic resins, polyesters, poly(vinyl butyral), polyisocyanate resins, polyurethanes, poly(vinyl acetate), polyamides, chroman resins, dammar gum, ketone resins, maleic acid resins, vinyl polymers, such as polystyrene and polyvinyltoluene or copolymer of vinyl polymers with methacrylates or acrylates, poly (tetrafluoroethylene-hexafluoropropylene), low-molecular weight polyethylene, phenol-modified pentaerythritol esters, poly(styrene-co-indene-co-acrylonitrile), poly(styrene-co-indene), poly(styrene-co-acrylonitrile), poly(styrene-co-butadiene), poly(stearyl methacrylate) blended with poly (methyl methacrylate), copolymers with siloxanes and polyalkenes. These polymers can be used either alone or in combination. In a preferred embodiment of the invention, the polymer comprises a polyester or poly(styrene-co-butyl acrylate). Preferred polyesters are based on ethoxylated and/or propoxylated bisphenol A and one or more of terephthalic acid, dodecenylsuccinic acid and fumaric acid as they form an acceptable protective overcoat layer that generally survives the rigors of a packaging label.

To increase the abrasion resistance of the protective overcoat layer, polymers which are cross-linked or branched can be used. For example, poly(styrene-co-indene-co-divinylbenzene), poly(styrene-co-acrylonitrile-co-divinylbenzene), or poly(styrene-co-butadiene-co-divinylbenzene) can be used.

The polymer particles for the protective overcoat layer should be transparent, and are preferably colorless. But it is specifically contemplated that the polymer particle can have some color for the purposes of color correction, or for special effects. Thus, there can be incorporated into the polymer particle dye which will impart color. In addition, additives can be incorporated into the polymer particle which will give to the overcoat desired properties. For example, a UV absorber can be incorporated into the polymer particle to make the overcoat UV absorptive, thus protecting the sheet from UV induced fading or blue tint can be incorporated into the polymer particle to offset the native yellowness of the gelatin used in the gelatin salt conductive material.

In addition to the polymer particles which form the protective overcoat layer, there can be combined with the polymer composition other particles which will modify the surface characteristics of the element. Such particle arc solid and nonfusible at the conditions under which the polymer particles are fused, and include inorganic particles, like silica, and organic particles, like methylmethacrylate beads, which will not melt during the fusing step and which will impart surface roughness to the overcoat.

The surface characteristics of the protective overcoat layer are in large part dependent upon the physical characteristics of the polymer which forms the toner and the presence or absence of solid, nonfusible particles. However, the surface characteristics of the overcoat also can be modified by the conditions under which the surface is fused. For example, the surface characteristics of the fusing member that is used to fuse the toner to form the continuous overcoat layer can be selected to impart a desired degree of smoothness, texture or pattern to the surface of the element. Thus, a highly smooth fusing member will give a glossy surface to the imaged element, a textured fusing member will give a matte or otherwise textured surface to the clement, a patterned fusing member will apply a pattern to the surface of the article.

Suitable examples of the polymer latex binder include a latex copolymer of butyl acrylate, 2-acrylamido-2-methylpropanesulfonate, and acetoacetoxyethylmethacrylate. Other latex polymers which are useful include polymers having a 20 to 10,000 nm diameter and a Tg of less than 60° C. suspended in water as a colloidal suspension.

Examples of suitable coating aids for the protective overcoat layer include any water soluble polymer or other material that imparts appreciable viscosity to the coating suspension, such as high MW polysaccharide derivatives (e.g. xanthan gum, guar gum, gum acacia, Keltrol (an anionic polysaccharide supplied by Merck and Co., Inc.) high MW polyvinyl alcohol, carboxymethylcellulose, hydroxyethylcellulose, polyacrylic acid and its salts, polyacrylamide, etc). Surfactants include any surface active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

In another embodiment, the application of an ultraviolet polymerizable monomers and oligomers to the conductive materials is preferred. UV cure polymers are preferred, as they can easily be applied to the conductive material in both a uniform coating or a patterned coating. Preferred UV cure polymers include aliphatic urethane, allyl methacrylate, ethylene glycol dimethacrylate, polyisocyanate and hydroxyethyl methacrylate. A preferred photoinitiator is benzil dimethyl ketal. The preferred intensity of radiation is between 0.1 and 1.5 milliwatt/cm$^2$. Below 0.05,insufficient cross-linking occurs yielding a protective layer that does not offer sufficient protection for the protection of the conductive materials.

In another embodiment of the invention, the application of a pre-formed polymer layer to the outermost surface of the conduits form an protective overcoat layer is most preferred. Application of a pre-formed sheet is preferred because pre-formed sheets are tough and durable easily withstanding the environmental solvents and handling forces. Application of the pre-formed polymer sheet is preferable carried out though lamination after image development. An adhesive is applied to either the photographic label or the pre-formed polymer sheet prior to a pressure nip that adheres the two surfaces and eliminates any trapped air that would degrade the quality of the transmitted light.

The preformed sheet preferably is an oriented polymer because of the strength and toughness developed in the orientation process. Preferred polymers for the flexible substrate include polyolefins, polyester and nylon. Preferred polyolefins include polypropylene, polyethylene, polymethylpentene, polystyrene, polybutylene, and mixtures thereof Polyolefin copolymers, including copolymers of propylene and ethylene such as hexene, butene, and octene are also useful. Polypropylene is most preferred, as it is low in cost and has desirable strength and toughness properties required for a pressure sensitive label.

In another embodiment, the application of a synthetic latex to the conductive materials to form a protective overcoat layer is preferred. A coating of synthetic latex has been shown to provide an acceptable protective overcoat layer and can be coated in an aqueous solution eliminating exposure to solvents. The coating of latex has been shown to provide an acceptable protective overcoat layer for conductive circuits. Preferred synthetic latexes for the protective overcoat layer are made by emulsion polymerization techniques from styrene butadiene copolymer, acrylate resins, and polyvinyl acetate. The preferred particles size for the synethetic latex ranges from 0.05 to 0.15 μm. The synthetic latex is applied to the outermost layer of the silver halide imaging layers by known coating methods that include rod coating, roll coating and hopper coating. The synthetic latexes must be dried after application and must dry transparent so as not to interfere with the quality of the transmitted light energy.

Silver halide imaging layers are preferred because they provide excellent sharpness, fine resolution of the indicator lines and can be written from a digital file. A silver halide emulsion capable of forming black and white indicator patterns having a density greater than 2.5 is preferred. A density greater than 2.5 allows for an improvement in the signal to noise ratio. Further, the higher the density, the higher the contrast between the reflective areas of the timing device and the high density areas of the timing device. A high contrast ratio allows for improving information density thus reducing the size of the timing device or increasing the amount of information on the timing device. A high density black and white emulsion is formed by increasing the amount of silver halide in the emulsion and as the latent image is converted to metallic silver, the density of the indicator lines increases.

A silver halide emulsion capable of forming high contrast is preferred. High contrast improves signal to noise ratio and allows for higher information density. Indicator line density is related to the log exposure range. The preferred log exposure range for the light sensitive silver halide imaging layers of the invention are between 0.51 and 0.95. This log exposure range has been shown to provide the desired contrast for common emitters and detectors utilized for timing devices.

In another preferred embodiment of the invention, the base is provided with light sensitive silver halide layers on both on each side of the base. Application of light sensitive silver halide layers on both sides allows the material of the invention to contain indicator patterns on both sides. Double sided timing devices, which require two emitters/detectors, allow for space savings and mechanical components savings. The double sided material can also be used to build in redundancy (substantially the same indicator pattern on both sides) into high performance systems or different indicator patterns can be used for separate control systems. In a special case, a patterned specular reflective layer containing reflective areas and transmissive areas can be utilized with silver halide imaging layers applied to both sides of the base allowing for simultaneous exposure of top imaging layer and the bottom imaging layer through the pattern.

To improve the signal to noise ratio of the indicator element, silver halide imaging layers containing high transparency gelatin are preferred. High transparency gelatin allows source light energy to efficiently be transmitted through the density minimum areas of the indicator pattern and be reflected back through the gelatin toward the detector. A gelatin having a transparency of greater than 94% measured in a 25 micrometer layer is preferred. In order to have high transparency, pig gelatin is preferred. Pig gelatin is known to have higher transparency that typical, lower cost cow gelatin and does improve the signal to noise ratio compared to cow gelatin. Further, pig gelatin tends to have lower gel strength and thus will curl less at lower humidity further reducing signal to noise ratio of a timing device.

The structure of a preferred light sensitive silver halide material suitable for patterning indicator lines for use as a timing device is as follows:

| |
|---|
| Light sensitive silver halide imaging layers |
| Subbing layer |
| Transparent polyester 75 micrometers thick |
| 1100 angstroms of metallic silver |
| Acrylic pressure sensitive adhesive |
| 900 angstroms of metallic silver |
| Transparent polyester 75 micrometers thick |

In the following discussion of suitable materials for use in elements of this invention, reference will be made to Research Disclosure, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12*a* North Street, Emsworth, Hampshire P0107DQ, ENGLAND. The foregoing references and all other references cited in this application, are incorporated herein by reference.

Suitable silver halide emulsions and their preparation as well as methods of chemical and spectral sensitization are described in Sections I through V. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections. A typical photographic element of the invention comprises a transparent support, a layer containing the dispersed filter dye adjacent the support, a light sensitive silver halide emulsion layer over the filter dye layer and a protective overcoat top layer the layer containing the filter dye can be an antihalation layer. In other embodiments of the invention the silver halide emulsion layer is on one side of the support and the filter dye layer is on the opposite side of the support, for example, in the pelloid layer. Processing methods and agents in Sections XIX and XX.

In preferred embodiments of the invention, the photographic element contains a negative working silver halide emulsion and a negative image can be formed.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,859,578; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging agents such as derivatives of hydroquinones, aminophenols, amines, gallic acid; catechol; ascorbic acid; hydrazides; sulfonamidophenols.

The silver halide used in the photographic elements may be silver iodobromide, silver bromide, silver chloride, silver chlorobromide, silver chloroiodobromide, and the like. Further, the high contrast silver halide imaging layers may comprise a combination of yellow, magenta and cyan dyes to for black. Silver chloride is preferred because it can be easily processed and forms high density.

The type of silver halide grains preferably include polymorphic, cubic, and octahedral. The grain size of the silver halide may have any distribution known to be useful in photographic compositions, and may be either polydipersed or monodispersed.

The silver halide grains to be used in the invention may be prepared according to methods known in the art, such as those described in Research Disclosure I and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Dopants can be employed to modify grain structure and properties as disclosed in Research Disclosure I section I-C(3) and Research Disclosure, Item 3736, November 1994. Typical dopants include Periods 3–7 ions including Group VIII metal ions (Fe, Co, Ni and the platinum metals, Ru, Rh, Pd, Re, Os, Ir and Pt), Mg, Al, Ca, Sc, Ti, V, Cr, Mn, Cu, Zn, Ga, As, Se, Sr, Y, Mo, Zr, Nb, Cd, In, Sn, Sb, Ba, La, W, Au, Hg, TI, Pb, Bi, Ce and U. The dopants can be introduced during the precipitation step during the formation of the silver halide grains.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in Research Disclosure I and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in Research Disclosure I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in Research Disclosure I. The vehicle can be present in the emulsion in any amount useful in photographic emulsions. The emulsion can also include any of the addenda known to be useful in photographic emulsions.

These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80 degree. C., as described in Research Disclosure I, Section IV (pages 510–511) and the references cited therein.

The silver halide may be sensitized by sensitizing dyes by any method known in the art, such as described in Research Disclosure I. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed from a stored image (such as a computer stored image) by means of light emitting devices (such as light emitting diodes, lasers, CRTs and the like).

Photographic elements of the invention can be processed in any of a number of well-known photographic processes utilizing any of a number of well-known processing compositions, described, for example, in Research Disclosure I, or in T. H. James, editor, The Theory of the Photographic Process, 4th Edition, Macmillan, New York, 1977. Development of the indicator patterns is followed by fixing, washing and drying.

The invention has been described in detail with particular reference to certain preferred embodiments thereof, but it will be understood that variations and modifications can be effected within the spirit and scope of the invention. Unless otherwise indicated, percent composition refers to percent composition by weight. The following examples illustrate the practice of this invention. They are not intended to be exhaustive of all possible variations of the invention. Parts and percentages are by weight unless otherwise indicated.

EXAMPLES

All examples were tested for dry adhesion, ASTM D3359, Test Method A and wet adhesion, as described in U.S. Pat. No. 5,639,589.

Example 1

In example 1, a high contrast indicator element was made in accordance with the invention by encapsulating a metal layer by two layers of polymeric materials. The metal layers encapsulated by two polymer layers were coated with light sensitive silver halide imaging layers to provide indicator pattern. The invention will demonstrate several advantages compared to prior art silver halide indicator elements. The invention is advantaged because printing the outer surface of the polymer receives the image forming layer. The invention has the further advantage that the reflective metal layer is encapsulated and is more resistant to scratches or abrasion damage through handling prior to the image forming layer being added.

The following indicator materials element of the invention was constructed by laminating and coating the following layers:

a) An image forming layer, comprising a high density/high contrast silver chloride black and white emulsion was coated onto the outer surface of the first polymer layer over the adhesion promoting layer. The silver chloride imaging chemistry provided excellent density and high contrast.

b) A latex and gelatin adhesion promoting layer was applied to outer surfaces of the polymeric film to anchor the image forming layer.

c) First transparent polymer layer consisting of 100 micrometer polyester d) Metallic silver layer vacuum deposited to the first transparent polymer layer with a thickness of 100 nm.

e) An acrylic optical clear adhesive was used to laminate the first polymer layer (metallic silver metallized by vacuum deposition method) to the second polymer layer.

f) Second transparent polymer layer consisting of 100 micrometer polyester g) A backing layer consisting of vanadium pentoxide to provide antistatic and lubricating function was coated onto the outer surface of the second polymer surface.

The structure of example 1 was as follows:

| |
|---|
| AgCl image forming layer |
| Adhesion promoting layer |
| 1st transparent polyester layer |
| Metallic silver layer |
| Acrylic pressure sensitive adhesive |
| 2nd transparent polyester layer |
| Backing layer |

The wet and dry adhesion results are found in Table 1.

Examples 2–3

Examples 2 and 3, as described in this invention, incorporate a highly reflective polymer film in place of the metallic silver layer in Example 1. This configuration has advantages over the prior art because the outer surface on which the image forming layer is applied is a polymer surface and the reflectivity is achieved by a polymer layer instead of a metallic layer (which can cause problems in sensitization and processing of silver halide images. The structure of Examples 2 and 3 is the same except for the reflection layer. For examples 2 and 3, the multiple layer specular reflecting polymer film of 3M Radiant Light Film VM2000 (63 micrometers thick and consists of alternating layers of polyester and polyethylene napthalate) was laminated to a transparent polyester (approximately 100 micrometers thick) with one bare side and one side with a latex and gel subbing layer. Because the current 3M Radiant film is limited in its total thickness, it is insufficient for encoder application to use 3M film alone as the final structure will not be stiff enough to stay dimensionally stable when used at very low RH environment. VITEL® 3300B is a high molecular weight, aromatic, linear saturated polyester resin having a glass transition temperature of 11° C. and was used as thc adhesive to laminate the polyester film to the 3M film. VITEL® 3300B was dissolved in 2-butanone, at a concentration of 18% solids, and coated onto a 100 $\mu$m bare PET support, at a wet thickness of approximately 23 $\mu$m. The coating was dried for 15 minutes at a temperature of 66° C. to remove all solvent. The resulting dry thickness of the coated layer was approximately 4 $\mu$m (equivalent to a dry coverage of approximately 4.3 g/m$^2$). This coating was thermally laminated to 3M Radiant Light Film VM2000 using a laminator having a double-heated nip comprised of compliant rollers exerting moderate pressure, a web speed of 60 cm/min and roll temperatures of 93° C. The resultant lamination exhibited excellent bond strength and was unable to be separated without destruction of the reflective film. It has been determined that the adhesive coverage can be reduced to as little as 2 g/m$^2$ without compromising laminate integrity.

For example 2, the outside surface of the VM2000 film was treated with a surface treatment, comprising Glow Discharge Treatment (GDT), and a mixture of gelatin and latex polymer, which provides adequate adhesion between the high contrast AgCl layer and the polyester film. The structure of example 2 is as follows:

| |
|---|
| AgCl image forming layer |
| GDT treatment and latex/gelatin sub |
| Multiple layer specular reflecting polymer film |
| Acrylic pressure adhesive |
| Polyester film |
| Backing layer |

For example 3, the 3M Radiant Light Film VM2000 was laminated to the polyester film in the same manner as in example 2, but the subbing layer and silver halide image forming layer were applied to the outside surface of the polyester film. The results of dry and wet adhesion test are summarized in table 1. The structure for example 3 is as follows.

| |
|---|
| AgCl image forming layer |
| Adhesion promoting layer |
| Polyester film |
| Acrylic pressure adhesive |
| Multiple layer specular reflecting polymer film |
| Backing layer |

Comparative Examples 4–13

To fabricate a structure as described in U.S. Pat. Nos. 5,508,088 and 5,672,865 (prior art silver halide timing device), it is necessary to coat a silver halide image forming layer on a metallized surface. This example will show how the difficulty of applying gelatin based imaging layers directly to metallic layers. The substrate is first metallized, then a subbing layer is applied to the metal layer and finally a silver halide emulsion is coated on the subbing layer. The structure for comparative examples 4–13 are as follows.

| |
|---|
| AgCl imaging layer |
| Adhesion promoting layer of the example |
| Metallic silver layer |
| Polyester film |

The metallization process was carried out by conventional vapor deposistion process in which 1000 angstroms of silver were deposited on uncoated polyester (approximately 100 micrometers thick). The metallic silver had excellent adhesion to the polyester surface. An adhesion promoting layer was then coated on top of the metal surface such that the image forming layer could be anchored. The different formulations of the adhesion promoting layer form comparison examples 4–13. The dry and wet adhesion of the image forming layer (black and white AgCl) to metal surface results are found in Table 2. Wet adhesion is especially critical as the image forming layer needs to survive wet chemicals during sensitization and processing of the indicator element.

TABLE 1

| Examples | Trade Name | Chemical Type | Coating Vehicle | Emulsion Adhesion-Dry | Emulsion Adhesion-Wet |
|---|---|---|---|---|---|
| 1 | | | | Excellent | Excellent |
| 2 | | | | Excellent | Excellent |
| 3 | | | | Excellent | Excellent |
| 4 | AQ 55D | Polyester ionomer | Water | Good | Poor |
| 5 | AQUAZOL 50 | Poly(2-ethyl-2-oxazoline) | Water | Poor | Poor |
| 6 | EPON 1009F | Epoxy | 2-Butanone | Poor | Poor |
| 7 | Paphen PKHH | Phenoxy | 2-Butanone | Poor | Poor |
| 8 | TYLAC 68219-00 | Styrene-butadiene copolymer | Water | Excellent | Poor |
| 9 | UNIREZ | Polyamide | n-Propanol | Poor | Poor |
| 10 | VITEL 3300B | Polyester | 2-Butanone | Poor | Poor |
| 11 | | Gelatin (high MW, fish) | Water | Excellent | Poor |
| 12 | | Glycidyl methacrylate-butyl acrylate copolymer | Ethanol | Excellent | Poor |
| 13 | | Poly (vinylpyrrolidone-co-vinyl-acetate | n-Propanol | Fair | Poor |

As the data in table 1 above clearly demonstrates silver halide imaging layer, such as the high contrast imaging layers used in this example do not adhere well to directly metallic layers as indicated in the prior art. Further, a wide range of commercially adhesion promoting layers were tested to improve the silver halide imaging layers to the metallic specular reflecting layers. Surprisingly, The data in table 1 shows poor adhesion of the silver halide imaging layers to the metallic layers with the use of adhesion promoting layers as the prior art suggested that acceptable adhesion of the silver halide imaging layers to metallic layers was feasible by way of description and examples. Poor adhesion of the silver halide material to the specular reflecting base of the invention significantly reduces the reliability and quality of indicator devices that must precision locate physical structures in operating space. The use of an adhesion layer applied to the surface of a polymer substrate provided excellent adhesion between the silver halide imaging layers and the polymer. Because the polymer layer utilized in the example was transparent, the signal to noise ratio was not significantly impacted by the transparent polymer sheet, thus yielding a high quality, highly reflective indicator element.

Because the metallic specular reflecting layers were protected from ambient moisture and abrasion damage, the quality and reliability of the indicator element are improved compared to prior art materials that have indicator patterns applied directly to the metallic layers. Because the reflecting layers were applied directly to the surface of a transparent polymer utilizing a vacuum deposition process, the reflectivity of the metallic layer was excellent and is optimized when the measurement of reflectivity was taken through the transparent polymer sheet.

In addition to the metallic specular reflection layers, the polymer reflection materials yielded excellent adhesion results. Because the silver halide imaging layers are somewhat sensitive to metallic compounds, the polymeric reflection materials eliminate the process chemistry contamination and log exposure risk associated with metallic compounds.

Finally, while the example was directed at uniform reflection layers. The metallic reflection layer of the example could have been patterned by laser ablation of the metallic layers yielding an indicator element capable of utilizing more indicator information.

The invention has been described in detail with particular reference to certain preferred embodiments thereof, but it will be understood that variations and modifications can be effected within the spirit and scope of the invention.

What is claimed is:

1. Material to form an indicator element comprising a base material-and at least one photosensitive silver halide layer, wherein said base material comprises at least one specular reflective layer between two polymer layers, wherein said polymer layer between said at least one specular reflective layer and said silver halide layer is substantially transparent, and wherein said base comprises multiple specular reflective layers.

2. The material of claim 1 wherein said at least one specular reflective layer comprises metal.

3. The material of claim 1 wherein said at least one specular reflective layer comprises silver.

4. The material of claim 1 wherein said at least one specular reflective layer comprises polymer specular reflective material.

5. The material of claim 1 wherein said at least one substantially transparent polymer layer comprises polyethyleneterephalate.

6. The material of claim 1 wherein said polymer layers are selected from a group consisting of cellulose triacetate, polyethylenenapthalate, and polycarbonate.

7. The material of claim 1 wherein said photosensitive silver halide comprises silver halide emulsion capable of forming a black and white indicia having a density of greater than 2.5.

8. The material of claim 7 wherein said silver halide emulsion is capable of forming an image having a contrast between 0.51 and 0.95.

9. The material of claim 1 wherein said photosensitive silver halide layers contain greater than 0.34 $mg/m^2$ silver.

10. The material of claim 1 wherein said material is further provided with a photosensitive silver halide layer on each side.

11. The material of claim 1 wherein said base has a specular reflectivity of between 95 and 99.2%.

12. The material of claim 1 wherein said base has a specular reflectivity of between 65 and 99.5%.

13. The material of claim 1 wherein said at least one specular reflective layer comprises metal and has a thickness of between 800 and 1500 angstroms.

14. The material of claim 1 wherein said at least one specular reflective layer comprises metal and has a thickness of between 500 and 5000 angstrums.

15. The material of claim 1 wherein said material further comprises a subbing layer to promote adhesion of said photosensitive silver halide layer to said substantially transparent polymer layer.

16. The material of claim 15 wherein said subbing layer has an index of refraction substantially the same as said substantially transparent polymer layer.

17. The material of claim 15 wherein said subbing layer has an index of refraction within 0.05 of said substantially transparent polymer layer.

18. The material of claim 1 wherein said at least one specular reflective layer is in a pattern.

19. The material of claim 1 wherein said material comprises an encoder.

20. The material of claim 1 wherein said photosensitive silver halide layer comprises a gelatin having a transparency of at least 94%.

21. The material of claim 1 wherein said photosensitive silver halide layer comprises a pig gelatin.

22. The material of claim 1 wherein said material comprises a disk encoder.

23. The material of claim 1 further comprising at least one adhesive layer between said specular reflective layer and said polymer layer opposite to said silver halide layer.

24. The material of claim 1 further comprising a dye between said at least one silver halide layer and said at least one specular reflective layer.

25. The material of claim 1 further comprising a dye in said at least one specular reflective layer.

26. An indicator element comprising a base material and at least one layer comprising silver indicia, wherein said base material comprises at least one specular reflective layer between two polymer layers wherein said polymer layer between said at least one specular reflective layer and said silver halide layer is substantially transparent, and wherein said base comprises multiple specular reflective lavers.

27. The indicator element of claim 23 further comprising an environmental protection layer on the side of said at least one layer comprising silver indicia opposite to said at least one substantially transparent polymer layer.

28. The indicator element of claim 26 wherein said at least one specular reflective layer has a pattern.

29. Material to form an indicator element comprising a base material and at least one photosensitive silver halide layer, wherein said base material comprises at least one specular reflective layer between two polymer layers, wherein said polymer layer between said at least one specular reflective layer and said silver halide layer is substantially transparent, and wherein said at least one specular reflective layer comprises polymer specular reflective material.

30. The material of claim 29 wherein said at least one substantially transparent polymer layer comprises polyethyleneterephalate.

31. The material of claim 29 wherein said photosensitive silver halide comprises silver halide emulsion capable of forming a black and white indicia having a density of greater than 2.5.

32. The material of claim 29 wherein said base has a specular reflectivity of between 65 and 99.5%.

33. The material of claim 29 wherein said material further comprises a subbing layer to promote adhesion of said photosensitive silver halide layer to said substantially transparent polymer layer.

34. The material of claim 33 wherein said subbing layer has an index of refraction substantially the same as said substantially transparent polymer layer.

35. The material of claim 29 wherein said material comprises an encoder.

36. An indicator element comprising a base material and at least one layer comprising silver indicia, wherein said base material comprises at least one specular reflective layer between two polymer layers wherein said polymer layer between said at least one specular reflective layer and said silver halide layer is substantially transparent, and wherein said at least one specular reflective layer comprises polymer specular reflective material.

37. The indicator element of claim 36 wherein said at least one specular reflective layer has a pattern.

38. Material to form an indicator element comprising a base material and at least one photosensitive silver halide layer, wherein said base material comprises at least one specular reflective layer between two polymer layers, wherein said polymer layer between said at least one specular reflective layer and said silver halide layer is substantially transparent, and wherein said at least one specular reflective layer is in a pattern.

39. The material of claim 38 wherein said at least one specular reflective layer comprises metal.

40. The material of claim 38 wherein said at least one substantially transparent polymer layer comprises polyethyleneterephalate.

41. The material of claim 38 wherein said photosensitive silver halide comprises silver halide emulsion capable of forming a black and white indicia having a density of greater than 2.5.

42. The material of claim 38 wherein said base has a specular reflectivity of between 65 and 99.5%.

43. The material of claim 38 wherein said material further comprises a subbing layer to promote adhesion of said photosensitive silver halide layer to said substantially transparent polymer layer.

44. The material of claim 43 wherein said subbing layer has an index of refraction substantially the same as said substantially transparent polymer layer.

45. The material of claim 38 wherein said material comprises an encoder.

46. An indicator element comprising a base material and at least one layer comprising silver indicia, wherein said base material comprises at least one specular reflective layer between two polymer layers wherein said polymer layer between said at least one specular reflective layer and said silver halide layer is substantially transparent, and wherein said at least one specular reflective layer has a pattern.

47. The indicator element of claim 46 further comprising an environmental protection layer on the side of said at least one layer comprising silver indicia opposite to said at least one substantially transparent polymer layer.

* * * * *